US011198034B2

(12) United States Patent
Lo

(10) Patent No.: US 11,198,034 B2
(45) Date of Patent: Dec. 14, 2021

(54) CATERPILLAR TREADMILL

(71) Applicant: DK City Corporation, Taichung (TW)

(72) Inventor: Chiu-Hsiang Lo, Taichung (TW)

(73) Assignee: DK City Corporation, Taichung (TW)

( * ) Notice: Subject to any disclaimer, the term of this patent is extended or adjusted under 35 U.S.C. 154(b) by 34 days.

(21) Appl. No.: 16/501,463

(22) Filed: Dec. 2, 2017

(65) Prior Publication Data

US 2020/0114198 A1 Apr. 16, 2020

(51) Int. Cl.
*A63B 22/02* (2006.01)

(52) U.S. Cl.
CPC ..... *A63B 22/0285* (2013.01); *A63B 22/0235* (2013.01)

(58) Field of Classification Search
CPC .... B65G 17/06; B65G 17/061; B65G 17/063; B65G 17/065; B65G 17/067; B65G 17/08; B65G 17/083; B65G 17/086; B65G 25/02; B65G 25/06; B65G 25/065; A63B 22/02; A63B 22/0235; A63B 22/00242; A63B 22/025; A63B 22/0257; A63B 22/0285
See application file for complete search history.

(56) References Cited

U.S. PATENT DOCUMENTS 2,007,910 A * 7/1935 Stephens ..... B65G 39/06 198/813
5,336,144 A * 8/1994 Rodden ..... A63B 22/02 482/51
5,470,293 A * 11/1995 Schonenberger ..... A63B 22/02 482/54
5,509,872 A * 4/1996 Chen ..... A63B 22/02 482/51
8,951,167 B2 * 2/2015 Chen ..... A63B 22/0242 482/54
10,238,912 B2 * 3/2019 Chen ..... A63B 21/4034
10,632,339 B2 * 4/2020 Chen ..... A63B 22/02
2004/0023757 A1 * 2/2004 Fox ..... F16C 13/00 482/54
2010/0331148 A1 * 12/2010 Huang ..... B65G 39/09 482/54
2012/0184413 A1 * 7/2012 Lo ..... A63B 22/0235 482/54
2018/0264315 A1 * 9/2018 Chen ..... A63B 22/0285

* cited by examiner

*Primary Examiner* — Garrett K Atkinson
*Assistant Examiner* — Zachary T Moore

(57) ABSTRACT

A caterpillar treadmill includes a non-rotational axle, a roller, a driver wheel, a follower wheel, two caterpillars, and tread slats. The roller is rotationally supported on the non-rotational axle. The driver wheel includes teeth on an external face, and is connected to the roller so that the driver wheel is rotatable together with the roller. The follower wheel includes teeth on an external face, and is connected to the roller so that the follower wheel is rotatable together with the roller. The first caterpillar is wound on the driver wheel and includes, on an internal face, racks engaged with the teeth of the driver wheel. The second caterpillar is wound on the follower wheel and includes, on an internal face, racks engaged with the teeth of the follower wheel. The tread slats are attached to an external face of the caterpillars.

2 Claims, 6 Drawing Sheets

CATERPILLAR TREADMILL

BACKGROUND OF INVENTION

1. Field of Invention

The present invention relates to a treadmill and, more particularly, to a caterpillar treadmill.

2. Related Prior Art

A conventional treadmill includes a base, a front axle, a solid axle, two front wheels, two rear wheels and a caterpillar. The front axle is rotationally supported on the base by two bearings, and so is the rear axle. The front wheels are supported on the front axle so that they are rotatable with one another. The rear wheels are supported on the rear axle so that they are rotatable with one another. The caterpillar is wound on the front and rear wheels. A user drives the caterpillar while walking or running on the caterpillar. The user walks or runs along a middle line of the caterpillar. The weight of the user is exerted at a middle portion of each of the front and rear axles so that the front and rear axles tend to bend. Such bending is however not desirable. The front and rear axles can be made with a larger diameter to reduce such bending. However, such increasing of the diameter inevitably increases the weight and cost of the front and rear axles. Such increasing is not desirable.

The present invention is therefore intended to obviate or at least alleviate the problems encountered in prior art.

SUMMARY OF INVENTION

It is the primary objective of the present invention to provide a simple and precise caterpillar treadmill.

To achieve the foregoing objective, the caterpillar treadmill includes a non-rotational axle, a roller, a driver wheel, a follower wheel, two caterpillars, and tread slats. The roller is rotationally supported on the non-rotational axle. The driver wheel includes teeth on an external face, and is connected to the roller so that the driver wheel is rotatable together with the roller. The follower wheel includes teeth on an external face, and is connected to the roller so that the follower wheel is rotatable together with the roller. The first caterpillar is wound on the driver wheel and includes, on an internal face, racks engaged with the teeth of the driver wheel. The second caterpillar is wound on the follower wheel and includes, on an internal face, racks engaged with the teeth of the follower wheel. The tread slats are attached to an external face of the caterpillars.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
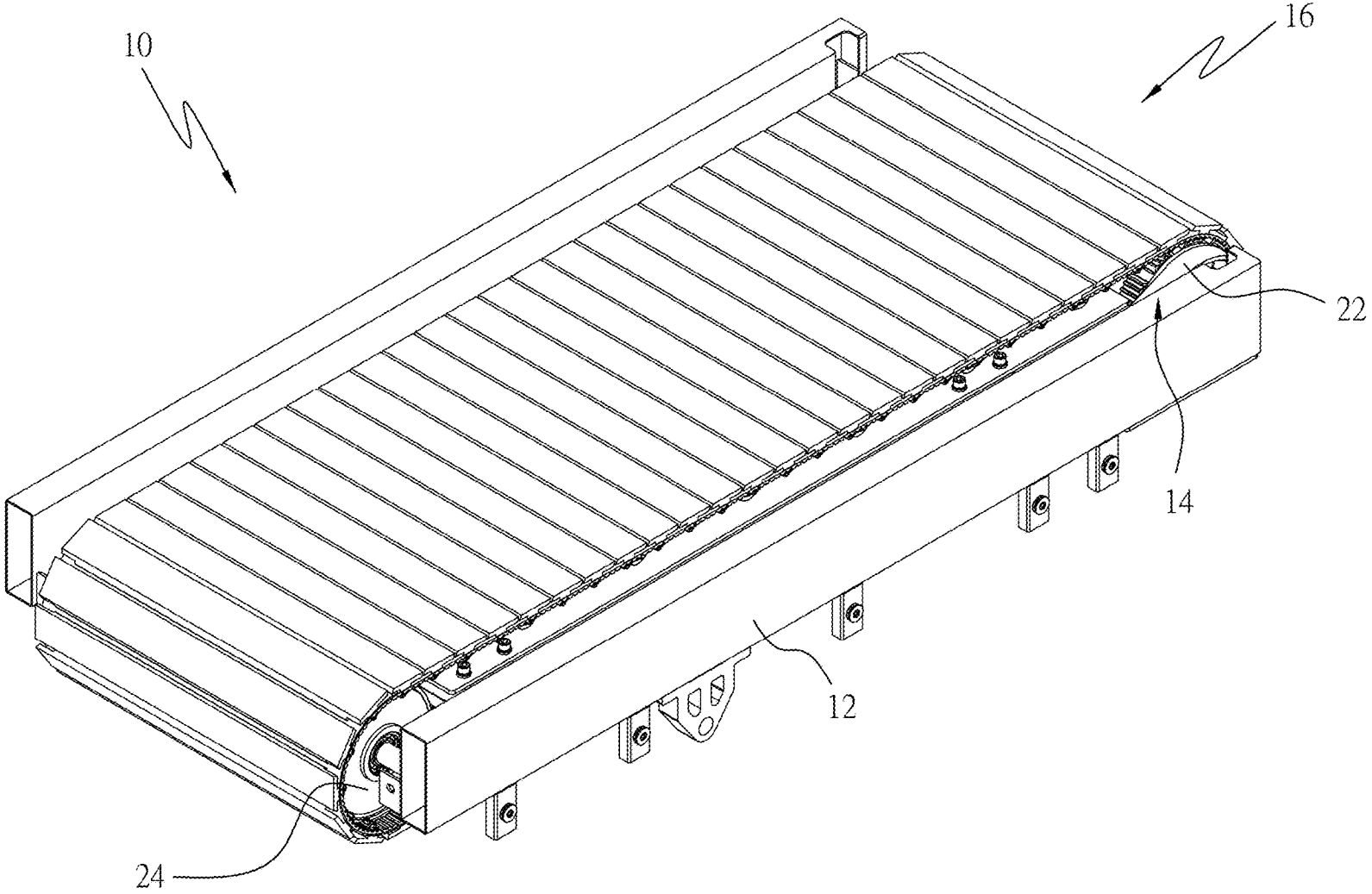
FIG. 1 is a perspective view of a base of a caterpillar treadmill according to the preferred embodiment of the present invention.
Figure 2:
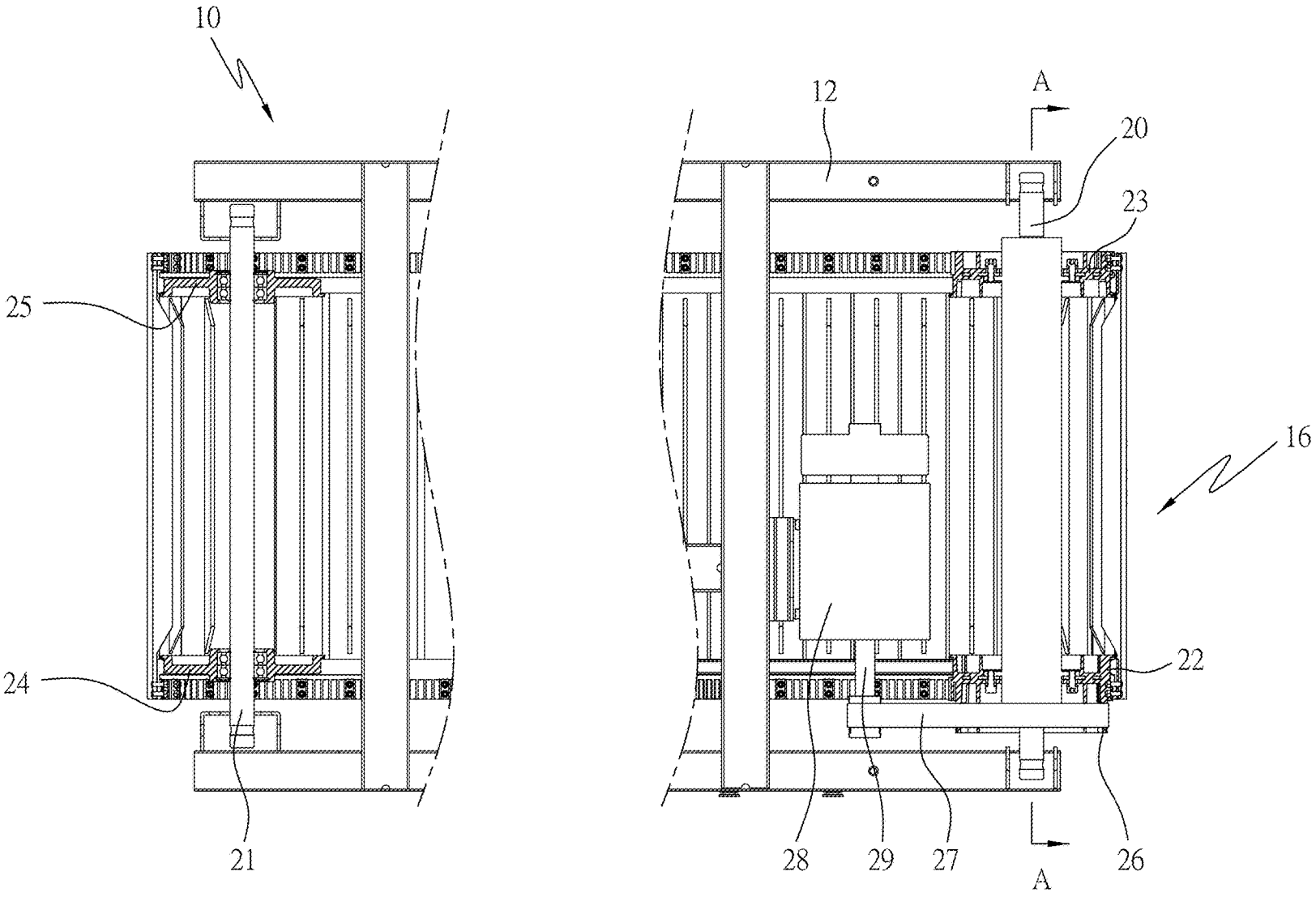
FIG. 2 is a partial, top view of the base of the caterpillar treadmill shown in FIG. 1.
Figure 3:
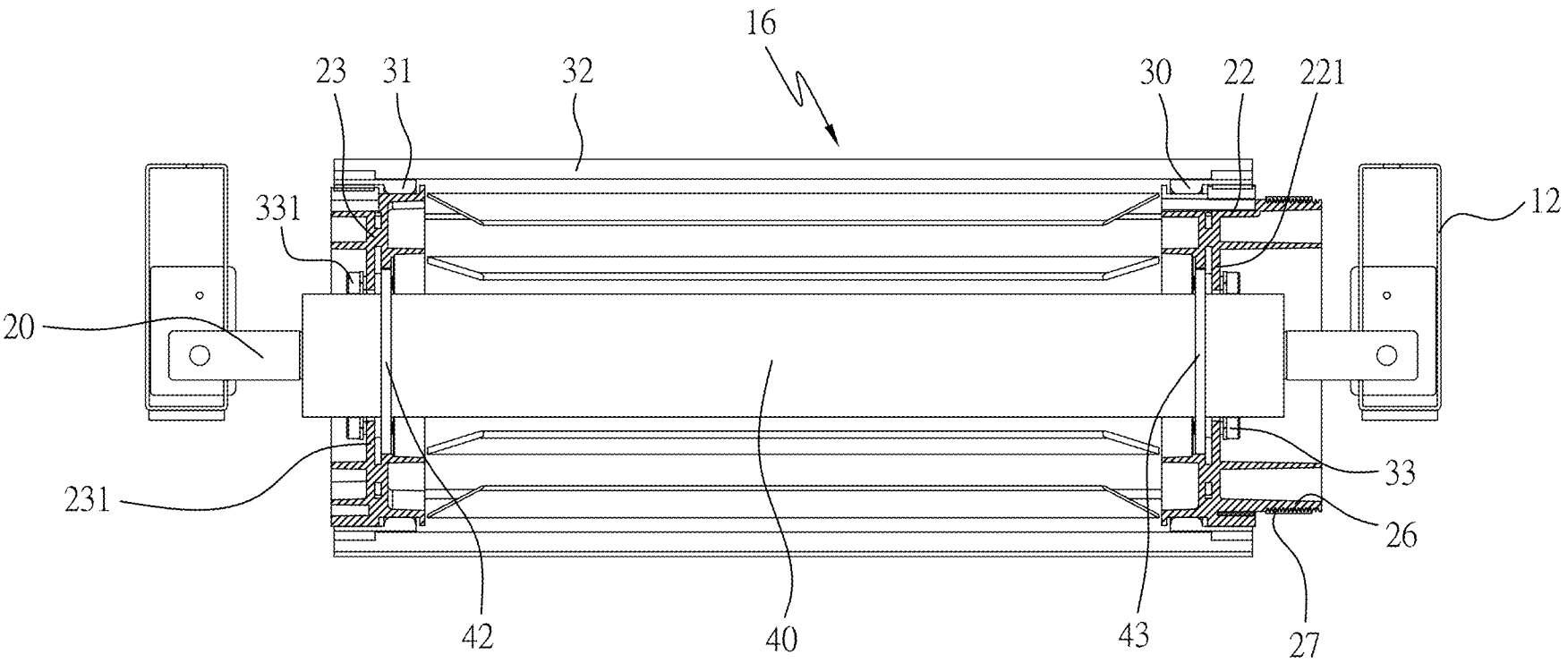
FIG. 3 is an enlarged, cross-sectional view of the base of the caterpillar treadmill taken along a line A-A shown in FIG. 2.
Figure 4:
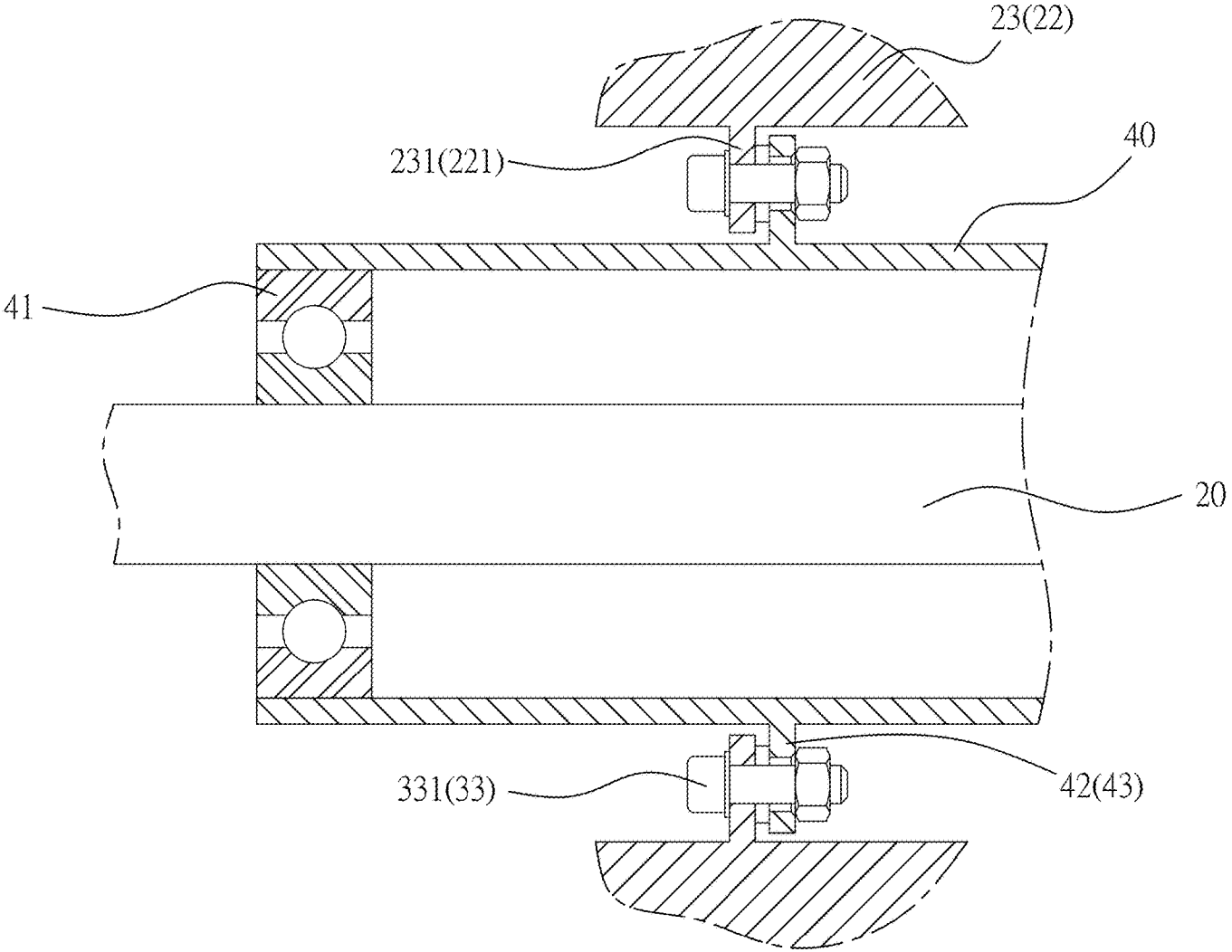
FIG. 4 is an enlarged, partial, cross-sectional view of the base of the caterpillar treadmill shown in FIG. 3.
Figure 5:
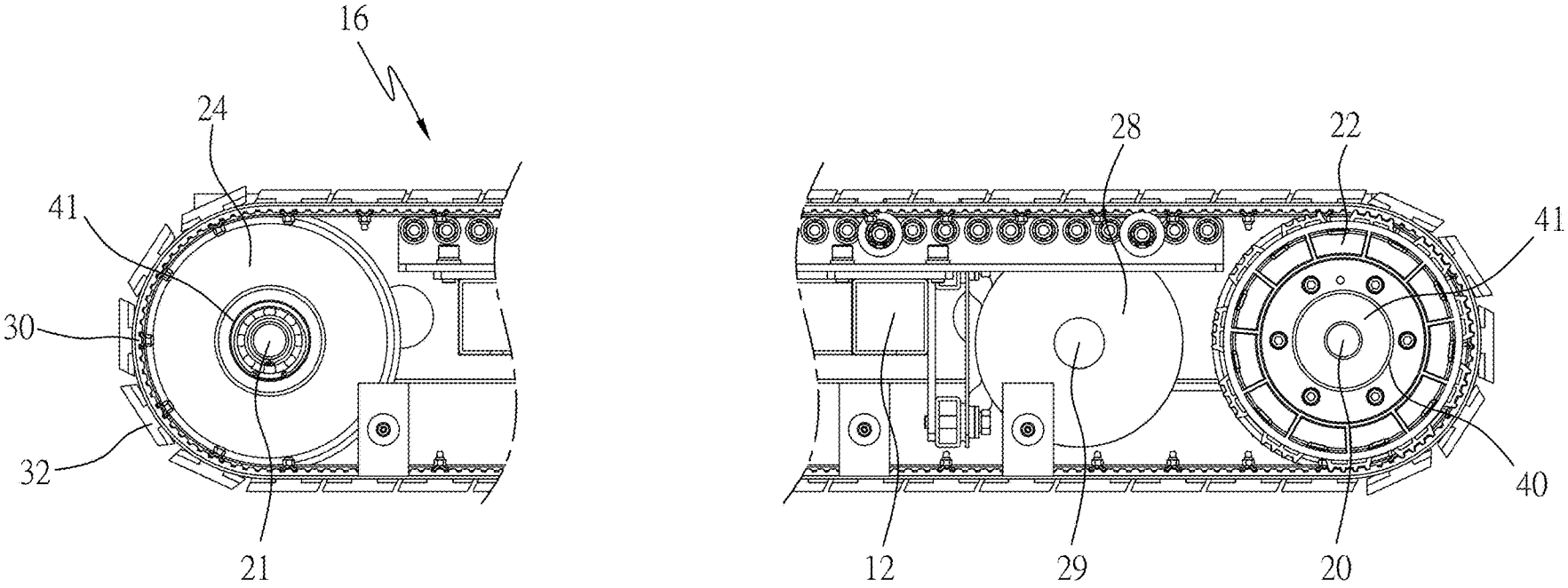
FIG. 5 is a partial, side view of the base of the caterpillar treadmill shown in FIG. 1.
Figure 6:
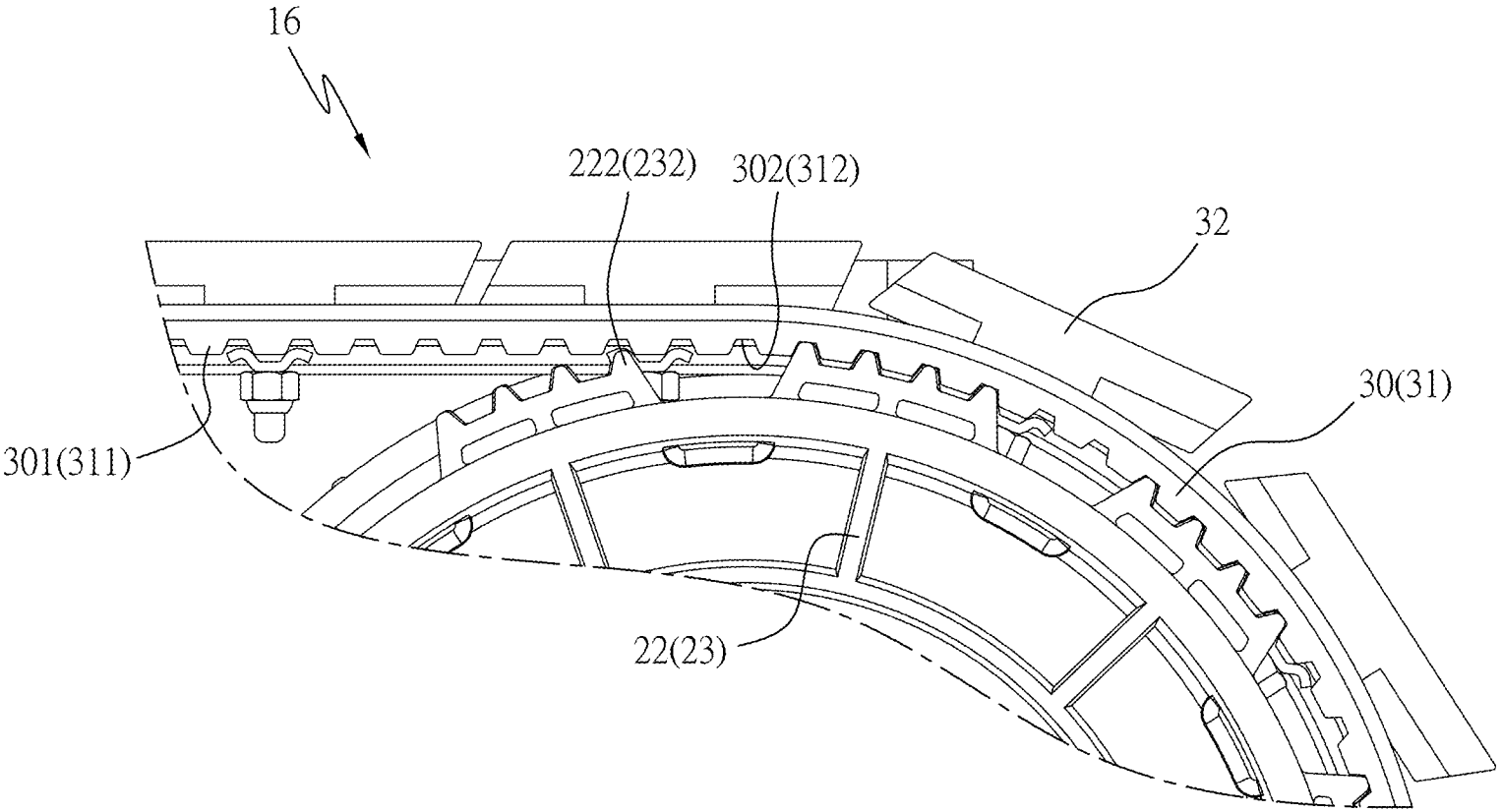
FIG. 6 is an enlarged, partial, side view of the base of the caterpillar treadmill shown in FIG. 5.

Referring to FIG. 1, there is a base 10 of a caterpillar treadmill according to the preferred embodiment of the present invention. Base 10 includes a frame 12, a drive unit 14 and a caterpillar unit 16. Drive unit 14 is supported on frame 12. Caterpillar unit 16 is supported on and driven by drive unit 14.

Referring to FIGS. 2 through 6, caterpillar unit 16 includes two caterpillars 30 and 31 and a plurality of tread slats 32. Tread slats 32 extend substantially parallel to one another. Tread slats 32 are attached to an external face of each of caterpillars 30 and 31. Caterpillars 30 and 31 are not identical to loops made of PVC that are also often used in treadmills.

Caterpillars 30 and 31 are made of a polymer or composite material. Caterpillar 30 includes racks 301 evenly arranged on an internal face and recesses 302 for separating racks 301 from one another. Caterpillar 31 includes racks 311 evenly arranged on an internal face and recesses 312 for separating racks 311 from one another. The arrangement of racks 301 and 311 does not interfere with the connection of caterpillars 30 and 31 to tread slats 32.

Drive unit 14 includes a non-rotational axle 20, a rotational axle 21, a driver wheel 22, follower wheels 23, 24 and 25, a pulley 26, a belt 27 and a motor 28. Non-rotational axle 20 is non-rotationally supported on frame 12. Rotational axle 21 is rotationally supported on frame 12. Non-rotational axle 20 is separated from rotational axle 21. Preferably, driver wheel 22 and pulley 26 are made in one piece. Motor 28 is non-movably supported on frame 12. Motor 28 includes a mandrel 29. Belt 27 is wound on pulley 26 and mandrel 29.

A roller 40 is rotationally supported on non-rotational axle 20 by at least two bearings 41. Driver wheel 22 and follower wheel 23 are taken as a group supported on roller 40 so that driver wheel 22 and follower wheel 23 are rotatable together with roller 40. Driver wheel 22 is located near an end of roller 40. Follower wheel 23 is located near another end of roller 40. Follower wheels 24 and 25 are taken as another group supported on rotational axle 21. Driver wheel 22 and follower wheel 24 are located on a side of caterpillar unit 16 while follower wheels 23 and 25 are located on another side of caterpillar unit 16.

Driver wheel 22 includes teeth 222 on an external face. Follower wheel 23 includes teeth 232 on an external face. Teeth 222 are inserted in some of recesses 302 and engaged with some of racks 301 at any given moment. Teeth 232 are inserted in some of recesses 312 and engaged with some of racks 311 at any moment. Hence, caterpillars 30 and 31 are driven by driver wheel 22 and follower wheel 23, respectively. Accordingly, tread slats 32 are moved relative to non-rotational axle 20.

As discussed above, motor 28 directly drives driver wheel 22 only. Driver wheel 22 drives follower wheel 23 via roller 40. Hence, driver wheel 22, follower wheel 23 and roller 40 are rotatable together on non-rotational axle 20.

Roller 40 includes two external annular flanges 42 and 43. External annular flange 42 is located near an end of roller 40.

External annular flange 43 is located near another end of roller 40. Driver wheel 22 includes an internal annular flange 221 near external annular flange 43. Follower wheel 23 includes an internal annular flange 231 near external annular flange 42. Internal annular flange 221 is connected to external annular flange 43 by fasteners 33. Internal annular flange 231 is connected to external annular flange 42 by fasteners 331. Hence, driver wheel 22 and follower wheel 23 are connected to roller 40.

The points of internal annular flange 221 and the points of external annular flange 43 for receiving fasteners 33 are precisely measured and tooled. The points of internal annular flange 231 and the points of external annular flange 42 for receiving fasteners 331 are precisely measured and tooled. Hence, driver wheel 22 and follower wheel 23 are precisely arranged on roller 40 regarding at least position and angle so that caterpillars 30 and 31 can be provided on driver wheel 22 and follower wheel 23 very fast. That is, it takes a shorter period of time to assemble caterpillar unit 16.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A caterpillar treadmill comprising:

a non-rotational axle;

a roller rotationally supported on the non-rotational axle and formed with two external annular flanges;

a driver wheel made with teeth on an external face, wherein the driver wheel is further formed with an internal annular flange connected to one of the external annular flanges of the roller so that the driver wheel is rotatable together with the roller;

a follower wheel made with teeth on an external face, wherein the follower wheel is further formed with an internal annular flange connected to another one of the external annular flanges of the roller so that the follower wheel is rotatable together with the roller;

a first caterpillar wound on the driver wheel and formed, on an internal face, with a rack engaged with the teeth of the driver wheel, wherein the first caterpillar is a loop made of a material selected from the group consisting of a polymer and a composite material;

a second caterpillar wound on the follower wheel and formed, on an internal face, with a rack engaged with the teeth of the follower wheel, wherein the second caterpillar is a loop made of a material selected from the group consisting of a polymer and a composite material; and tread slats attached to an external face of each of the first and second caterpillars.

2. The caterpillar treadmill according to claim 1, further comprising a bearing arranged between the non-rotational axle and the roller.

* * * * *